US007428922B2

(12) United States Patent
Fripp et al.

(10) Patent No.: US 7,428,922 B2
(45) Date of Patent: Sep. 30, 2008

(54) VALVE AND POSITION CONTROL USING MAGNETORHEOLOGICAL FLUIDS

(75) Inventors: Michael Fripp, Carrollton, TX (US); Darren Barlow, Mansfield, TX (US); Brandon Soileau, Dallas, TX (US)

(73) Assignee: Halliburton Energy Services, Houston, TX (US)

( * ) Notice: Subject to any disclaimer, the term of this patent is extended or adjusted under 35 U.S.C. 154(b) by 465 days.

(21) Appl. No.: 10/090,054

(22) Filed: Mar. 1, 2002

(65) Prior Publication Data

US 2003/0166470 A1 Sep. 4, 2003

(51) Int. Cl.
*E21B 43/1185* (2006.01)

(52) U.S. Cl. ..... 166/66.5; 251/129.06

(58) Field of Classification Search ..... 166/66.5, 166/66.6, 66.7, 135, 334.1; 137/909; 251/129.06, 251/129.08

See application file for complete search history.

(56) References Cited

U.S. PATENT DOCUMENTS

| | | | | |
|---|---|---|---|---|
| 2,661,596 | A | | 12/1953 | Winslow |
| 4,718,494 | A | | 1/1988 | Meek |
| 4,785,300 | A | | 11/1988 | Chin et al. |
| 5,012,740 | A | * | 5/1991 | Hardt ..... 102/216 |
| 5,040,155 | A | | 8/1991 | Feld |
| 5,048,611 | A | | 9/1991 | Cochran |
| 5,073,877 | A | | 12/1991 | Jeter |
| 5,115,415 | A | | 5/1992 | Mumby et al. |
| 5,158,109 | A | * | 10/1992 | Hare, Sr. ..... 137/514.3 |
| 5,168,931 | A | | 12/1992 | Caskey et al. |
| 5,223,665 | A | | 6/1993 | Burleson |
| 5,284,330 | A | | 2/1994 | Carlson et al. |
| 5,586,084 | A | | 12/1996 | Barron et al. |
| 5,598,908 | A | * | 2/1997 | York et al. ..... 192/21.5 |
| 5,636,178 | A | | 6/1997 | Ritter |
| 5,787,052 | A | | 7/1998 | Gardner et al. |
| 6,019,201 | A | * | 2/2000 | Gordaninejad et al. ... 188/267.1 |
| 6,036,226 | A | * | 3/2000 | Brown et al. ..... 280/736 |
| 6,145,595 | A | | 11/2000 | Burris, II |
| 6,219,301 | B1 | | 4/2001 | Moriarty |
| 6,257,356 | B1 | | 7/2001 | Wassell |

(Continued)

FOREIGN PATENT DOCUMENTS

| | | |
|---|---|---|
| EP | 1236862 | 9/2002 |

(Continued)

OTHER PUBLICATIONS

Examination Report for UK application No. GB0303599.5.

(Continued)

*Primary Examiner*—Jennifer H Gay
*Assistant Examiner*—Daniel P Stephenson
(74) *Attorney, Agent, or Firm*—Marlin R. Smith

(57) ABSTRACT

Magnetorheological fluids, which solidify in response to a magnetic field, offer the ability to simplify many of the valves and control systems used downhole in the search for and production of oil and gas. They lessen the need for moving parts, provide solid-state valves, and can provide a differential movement of fluid through the valves by varying the strength of the magnetic field. Combinations of permanent and electro-magnets can improve safety by providing valves that fail, when power is lost, in either an open or closed position, depending on design. A number of examples are given.

27 Claims, 14 Drawing Sheets

U.S. PATENT DOCUMENTS

| | | | | |
|---|---|---|---|---|
| 6,280,658 | B1 | 8/2001 | Atarashi et al. | |
| 6,421,298 | B1 | 7/2002 | Beattie et al. | |
| 6,469,367 | B2 | 10/2002 | Kondo et al. | |
| 6,514,001 | B1 * | 2/2003 | Yezersky et al. | 403/109.1 |
| 6,568,470 | B2 | 5/2003 | Goodson | |
| 6,619,388 | B2 | 9/2003 | Dietz | |
| 6,926,089 | B2 | 8/2005 | Goodson, Jr. et al. | |
| 2003/0019622 | A1 | 1/2003 | Goodson, Jr. et al. | |
| 2003/0037921 | A1 | 2/2003 | Goodson, Jr. | |

FOREIGN PATENT DOCUMENTS

| | | | |
|---|---|---|---|
| GB | 2039567 A | * | 8/1980 |
| GB | 2396178 | | 6/2004 |

OTHER PUBLICATIONS

Official Action for Norwegian application No. 20030685.

British Search Report issued for GB Patent Application No. 0604850.8 on Jul. 10, 2006 (5 pages).

* cited by examiner

VALVE AND POSITION CONTROL USING MAGNETORHEOLOGICAL FLUIDS

TECHNICAL FIELD

The present invention relates to the use of magnetorheological fluids in downhole equipment to provide solid-state controls.

BACKGROUND OF THE INVENTION

Magnetorheological Fluids

In the 1950s, it was discovered that fluids could be created whose resistance to flow were modifiable by subjecting them to a magnetic or electric field. This was disclosed in U.S. Pat. No. 2,661,596, which is hereby incorporated by reference, where the inventor also disclosed its use in a hydraulic device. Those fluids that are responsive to an electrical field are known as electrorheological fluids while those responsive to magnetic fields are magnetorheological. Of these two, magnetorheological fluids have been the easier to work with, as their electrical counterparts are susceptible to performance-degrading contamination and require strong electric fields, which necessitate complicated, expensive high-voltage power supplies and complex control systems. In contrast, both permanent magnets and electromagnets are inexpensive and easy to produce, while the magnetorheological fluids are not as sensitive to contamination.

Magnetorheological (MR) fluids can be formed by combining a low viscosity fluid, such as a type of oil, with magnetic particles to form a slurry. The original patent used particles of iron on the order of 0.1 to 5 microns, with the particles comprising 20% or more by volume of the fluid. More recent work in MR fluids can be found, for instance, in U.S. Pat. No. 6,280,658. When a magnetic field passes through the fluid, the magnetic particles align with the field, limiting movement of the liquid due to the arrangement of the iron particles. As the field increases, the MR fluid becomes increasingly solid, but when the field is removed, the fluid resumes its liquid state again. FIG. 1 is a graph of the flow rate of an exemplary MR fluid through 0.4 inch inner diameter tubing versus the strength of the magnetic field applied to the fluid. In each case, the flow rate goes to zero as the field increases. Magnetorheological fluids have been used in such areas as dampers, locks, brakes, and abrasive finishing and polishing, with over 100 patents issued that utilize these fluids. MR fluids can be obtained from the Lord Corporation of Cary, N.C.

Downhole Equipment

Devices that are used in the development and production of hydrocarbon wells have a number of constraints to which they must adhere. They must be capable of handling the harsh environment to which they are subjected, be controllable from the surface, and be sized to fit within the small area of a borehole, yet the fact that they can be operating thousands of feet underground makes their reliability a high priority. Some of the problems encountered in drilling and production of hydrocarbons are as follows:

1) It is imperative to reliably be able to trigger an event when desired, but not before. For instance, the firing of guns used to create openings through the casing into a formation must release enough energy to fracture through not only the casing, but also through damaged sections of the formation. Premature firing of the guns is both a safety issue (i.e., personnel can be injured) and an economic issue (equipment can be damaged, openings made into undesired strata must be repaired or bypassed).

2) Many pieces of equipment used downhole have valves that must be opened and closed. In other equipment, the relationship between two parts must be fixed at some points in time, yet moveable at others, such in a travel joint, which makes up for the movement of a drilling ship as it floats on the surface of the ocean. Traditional apparatus has relied various physical means to operate valves or release a part from a fixed relationship. These can include rotating the drill string to release a J-fastener, relying on pressure, either within the string or in the annulus, to rupture a valve or to apply the pressure necessary to move a part, and shear pins or similar devices. It is desirable to have more reliable means of operating this equipment more precisely. Additionally, the use of moving parts leads to rigorous designs that have redress costs and require rig time to trigger the valves. It would be desirable to utilize solid-state valves to lower costs, improve reliability, and decrease rig time for activation.

3) It would be desirable to provide a simple means for performing logical control steps, without the use of moving parts.

4) Devices such as packers traditionally use hard rubber parts to seal between the downhole tubing and the casing or borehole. The rubber requires high pressures to set, and the inflatable packers that have been used will not hold the large differential pressures of those using rubber packers. An alternative is desirable that would not require large amount of force to set, but that would handle large differential pressures.

Because of the variety of devices disclosed in the current application, specific examples of prior art devices are more fully discussed before the inventive alternative is disclosed.

SUMMARY OF THE INVENTION

Numerous devices that utilize magnetorheological fluids are disclosed for use in oil and gas drilling and/or production. With their ability to act as solid-state valves, MR fluids can serve in areas such as 1) fluid valving systems for locking and safety devices, 2) hydraulic logic systems, 3) position control and shock absorption, and 4) acting as a valve for other fluids.

In locking and safety devices, it is disclosed to use MR fluids as a hydraulic fluid that controls a piston designed to initiate an event. The presence of a magnetic field can prevent the piston from moving, acting as a safety lock for critical events. Examples are given for tubing conveyed perforation (TCP) guns, but are practical for many other locking applications.

In hydraulic logic systems, it is disclosed to utilize MR fluid valves that have a logic value of "0" or "1" depending on whether or not a magnetic field is present. Systems can be designed to control downhole equipment by logical responses to sensor input. Valves can be tied together to create more complex logic It is further disclosed to control the position of one device relative to another device by MR systems. Movement of the devices relative to each other is tied to the movement of a piston through MR fluid; by blocking the flow of the MR fluid, the relative positions of the pieces are fixed. A magnetic field that is below that necessary to block flow can provide a time-delay or dampening effect.

In packers, it is disclosed to utilize an MR fluid in a packer, or other device to block the flow of other fluids. By solidifying the MR fluid, the seal can provide a strong barrier to the passage of other fluids, while its ability to have a fluid phase allows the MR fluid to conform to the walls of damaged wellbores. Little force is require to set the packer, yet it can hold large differential pressures.

Devices utilizing MR fluids will have one or more of the following advantages: they are generally simple designs, fit well into existing systems, have fewer moving parts, and can be designed to fail (if electrical connections are lost) in either a valve open or valve closed position. The MR fluid itself is relatively inexpensive, easily handled, non-toxic, and its viscosity can be varied by simply changing the magnetic field to which it is subjected. Magnetorheological fluid devices can offer simple, elegant solutions to a number of problems, as will be further discussed.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Embodiment of the disclosed system will now be discussed in further detail.

Overview of Valves Using Magnetorheological Fluid

Figure 1:
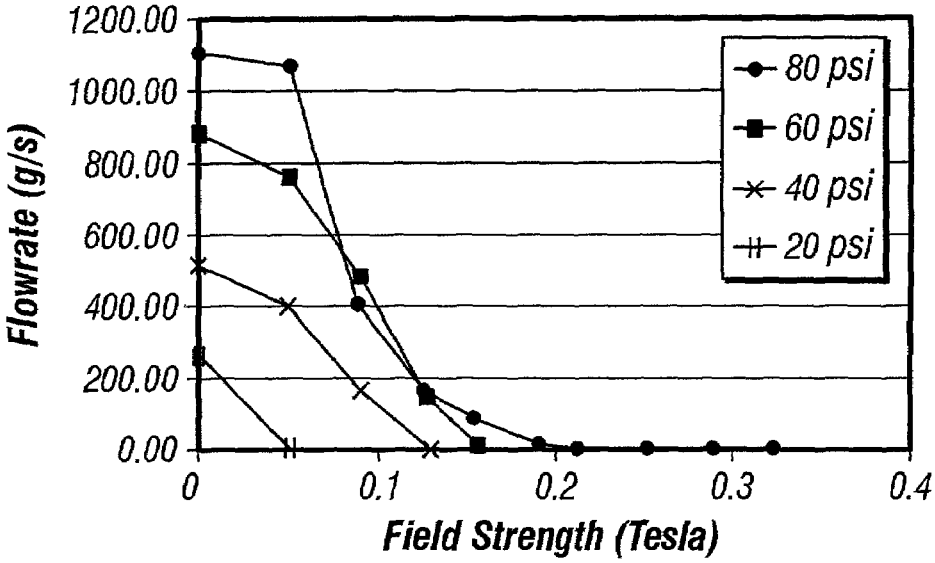
FIG. 1 shows an exemplary graph of the flow rate of a magnetorheological fluid versus the field strength of magnetic field applied to the fluid.
Figure 2A:
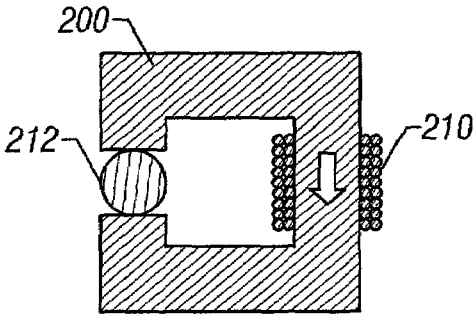
FIGS. 2A–E show various methods of constructing a magnetorheological valve assembly from magnets and/or electromagnets.
Figure 2B:
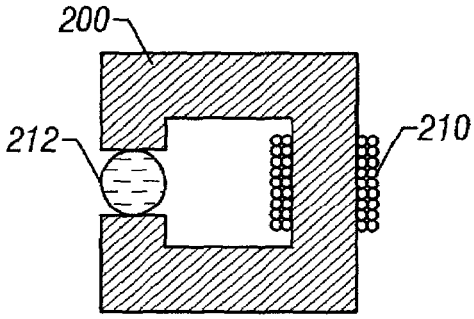

It is well known that if one side of an O-shaped piece of iron is wrapped with coils of an insulated conductor, an electromagnet can be formed. When a direct current is run through the coils, the iron underneath the coils is temporarily magnetized, with the polarity depending on the direction of current. The O-shaped piece of iron acts in a manner analogous to an electrical circuit to conduct the magnetic field, or flux, around the magnetic circuit created, so that the entire piece of iron becomes an electromagnet. If, however, a section of the magnetic circuit is removed, the magnetic field cannot flow, just as in an electrical circuit. FIG. 2A shows a circuit similar to that described above, except that a passageway 212 containing magnetorheological fluid replaces one section of the O-shaped iron 200. When the direct current is passed (shown by darkened coils) through the coils 210, the iron in the MR fluid completes the magnetic circuit. The MR fluid that is part of the circuit thickens or solidifies (shown by the lines of force through the fluid), depending on the strength of the magnetic field, while portions that are not subjected to the magnetic field remain liquid. In this embodiment, current is required to keep the valve closed, while a lack of current, shown in FIG. 2B, maintains the valve in an open position, with the MR fluid liquid (no lines of force).

Figure 2C:
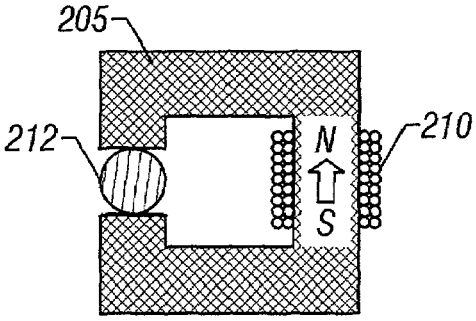
Figure 2D:
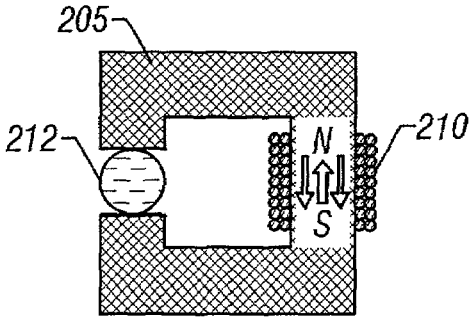
Figure 2E:
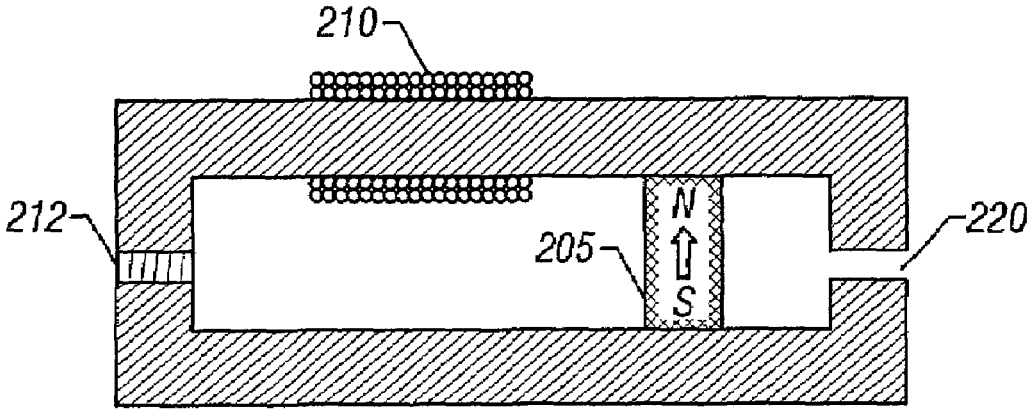

It is also possible to design a valve in which a lack of current closes a valve, while a current opens the valve. FIG. 2C shows an embodiment utilizing a combination of a permanent magnet and an electromagnet. Rather than using an O-shaped piece of iron, as in the previous example, an annular magnet 205 is used, with coils 210 wrapped around one section of the magnet 205. Because of the constant magnetic field created by the permanent magnet (note the lines of force), MR fluid in the passageway 212 will remain solidified until the flow of magnetic force is disrupted. In FIG. 2D, a current is supplied to the electromagnet, giving it a polarity which is opposite the polarity of the permanent magnet (note the opposing lines of force). The field strength of the electromagnet can be adjusted so that the field of the electromagnet cancels the field of the permanent magnet and the magnetic flux no longer flows. This allows the MR fluid to liquefy, opening the valve. FIG. 2E shows an alternate version of the valve of FIG. 2D. In this embodiment, it is more efficient to cancel the magnetic field only in the working gap (the container 212 of MR fluid) by redirecting the flux from the permanent magnet to a secondary, higher reluctance gap 220. If the coil 210 is off, most of the flux from the permanent magnet 205 flows through the primary gap 212 and solidifies the MR fluid, effectively closing the valve. If the coil 210 is activated, the electromagnet's flux cancels the flux from the permanent magnet at the primary gap 212, but doubles the flux at the secondary gap 220. This effectively redirects the flux to the secondary gap and opens the MR valve.

Figure 3A:
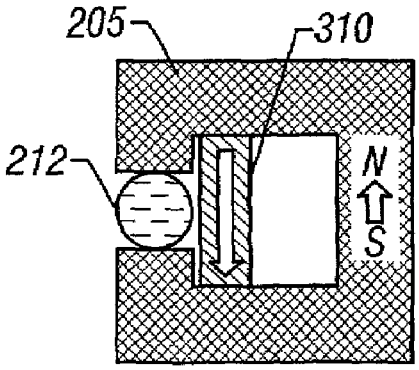
FIGS. 3A and 3B show less desirable methods of interrupting the magnetic flow.
Figure 3B:
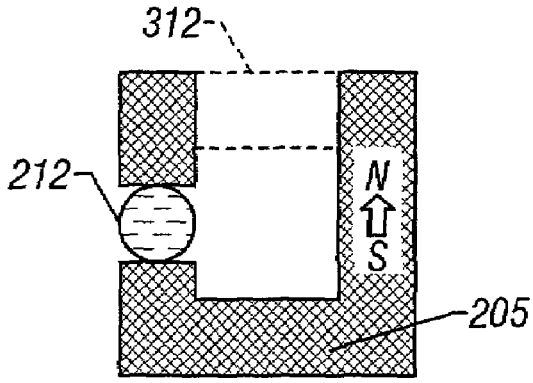

FIG. 3A shows an alternate means of negating the effect of the magnet 205 on the MR fluid in container 212. In this embodiment, the magnetic field is shunted through a piece of steel 310 that provides a short circuit, allowing the flux to flow without going through the section containing the MR fluid. FIG. 3B shows a method of interrupting the flow of flux by simply removing a piece 312 of the magnetic circuit, creating an open circuit. Both of these two embodiments require the movement of part of the circuit, to either add or remove a conductive piece. This could be done by applying fluid pressure, hydraulic pressure or mechanical force, but as the aim is to simplify the valve, these are much less preferred.

Building further on the use of MR fluids, the inventors of this application have identified a number of specific areas in downhole drilling and production in which magnetorheological fluid valves can be useful. These areas generally fall into four categories: fluid valves for locking and safety devices, hydraulic control circuits, position control, and blocking the flow of other fluids and will be discussed in these four general groups. Some applications do not fall easily into these groupings, but will be discussed where most appropriate.

Fluid Valves for Locking and Safety Devices

Locking and safety devices are devices that have a one-time operation, such that the system cannot be reestablished to its original condition. When dealing with the heavy equipment and high pressures inherent in oilfield work, safety becomes a very important issue, and fail-safe mechanisms are mandatory. Locking mechanisms are used to ensure that a desired action, such as detonation of a perforation gun, does not take place prematurely. Using solid-state magnetorheological valves as described above, safety devices can be locked in an immovable state until a magnetic field is removed using an electromagnet.

In a first application, we will look at a control system for a firing head in a tubing-conveyed perforation (TCP) gun that is operated using MR fluids. First, let us look closer at the problems in this area. Conventionally, a perforating gun is actuated through a firing head that is responsive either to mechanical forces, such as the impact provided by dropping a detonating bar through the tubing, or to fluid pressure, e.g., through hydraulic lines. Additionally, some hybrid systems exist. Such firing heads, where the piston is moved in response to hydraulic pressure, are believed to enhance the safety of the detonating system in that they are unlikely to detonate without a specific source of substantial fluid pressure, which would not be expected outside the wellbore.

To provide added safety, especially for a mechanically actuated firing head, detonation interruption devices are also used. These devices are typically attached between the firing head assembly and the perforating gun, and typically contain a eutectic alloy that melts at temperatures expected within a wellbore, but not at the surface, for example 135° F. In its solid form, the eutectic material prevents the detonation signal from reaching the perforating gun, preventing accidental detonation at the surface. When the device is downhole, the increased heat will melt the material and allow detonation. However, "normal" drilling conditions vary widely. Detonation interruption devices are very difficult to store in Saudi Arabia, for example, as surface temperatures can reach the material's melting point. In areas like Alaska, the opposite problem occurs, as downhole temperatures may only reach 70° F., preventing detonation when desired. These operations would typically rely on a pressure-operated firing head.

Figure 4:
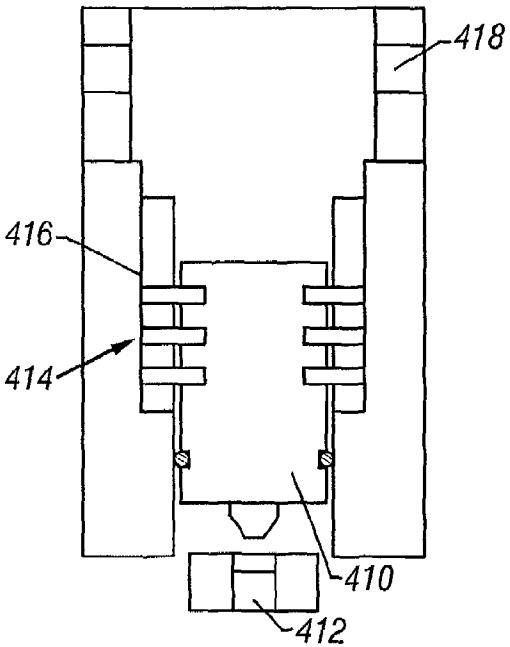
FIG. 4 (Prior Art)
FIG. 4 shows a conventional pressure-operated firing head for a perforation gun.

One example of a conventional pressure-operated firing head is seen in FIG. 4. A perforation gun is fired when the firing piston 410, powered by pressure applied through pressure port 418, contacts initiator 412. The pressure system is typically hydraulic, which means that as the well depth increases, the inherent hydraulic pressure in the pressure line becomes significant. In order to prevent accidental firings, shear pins 414, held by shear sleeve 416, hold firing piston 410 in place. To fire the gun, the pressure through pressure ports 418 is increased until shear pins 414 shear off, allowing firing piston 410 to move and strike initiator 412. As well depths increase, the number of shear pins necessary to hold the piston in place increases, with a concomitant rise in the pressure necessary to shear the pins. This increase can create additional problems depending on formation pressure and other completion equipment. The actuating pressures can become so high that either other equipment in the well cannot withstand it, or additional pressure would result in the well being completed in an over-balanced state as opposed to an under-balanced state. Thus, either safety factors are reduced or another means of firing must be found.

Figure 5:
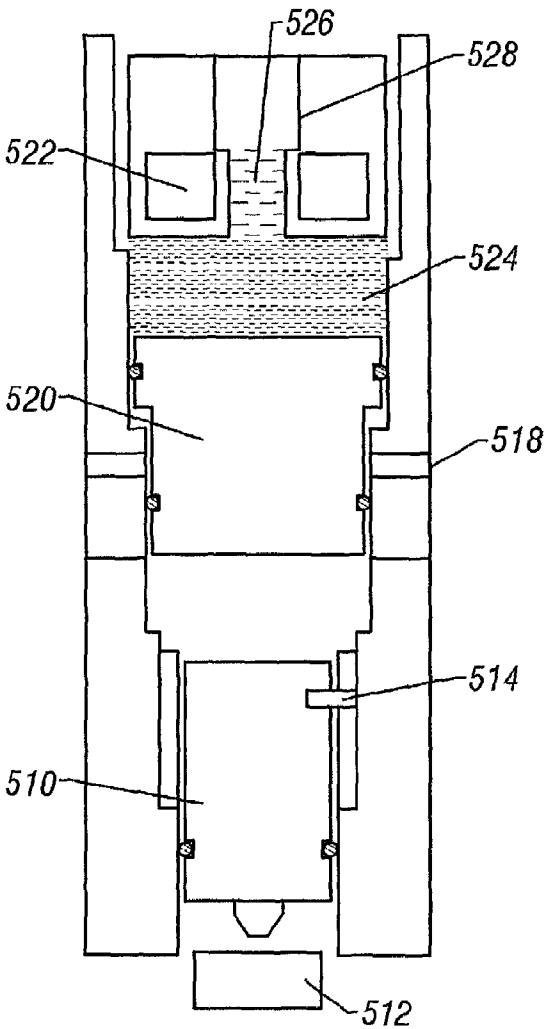
FIG. 5 shows an exemplary firing head designed with an MR fluid control

FIG. 5 shows a firing head designed with an MR fluid control. In this design, pressure port 518 is initially blocked by fluid piston 520, so that no pressure can be applied to firing piston 510. As the firing gun is lowered into the borehole, pressure would build up at pressure ports 518, tending to move fluid piston 520 upward and opening the pressure ports 518 to the firing piston 510. However, the movement of fluid piston 520 is prevented by the presence of MR fluid 524, held in place by solid MR fluid 526 between portions of magnetic assembly 522. Note that the magnetic assembly will be designed with a permanent magnet, so that the un-powered state of the valve is closed. The firing piston is not pressurized in this embodiment until the pressure ports are opened, so a single shear pin 514 is enough to hold firing piston 510 in place. To fire the gun, an electromagnet is actuated to counteract the magnetic field of magnetic assembly 522. Solid MR fluid 526 is liquefied, allowing MR fluid 524 to move into the fluid reservoir 528. This, in turn allows fluid piston 520 to move, opening pressure port 518, the pressure then breaks the shear pin and allows firing piston 510 to strike initiator 512.

Using an MR fluid controlled safety lock on the TCP gun gives a much safer application. The safety is provided by a permanent magnet that can prevent movement, and only the intentional act of canceling the magnetic field will allow the gun to fire.

Figure 6B:
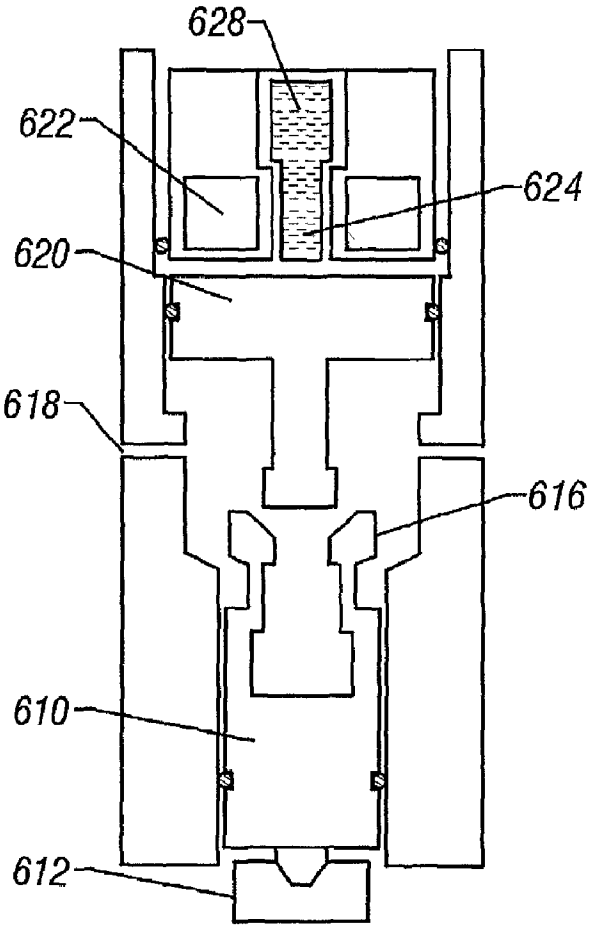
FIGS. 6A and B show an alternate embodiment of firing head designed with an MR fluid control before and during firing
Figure 6A:
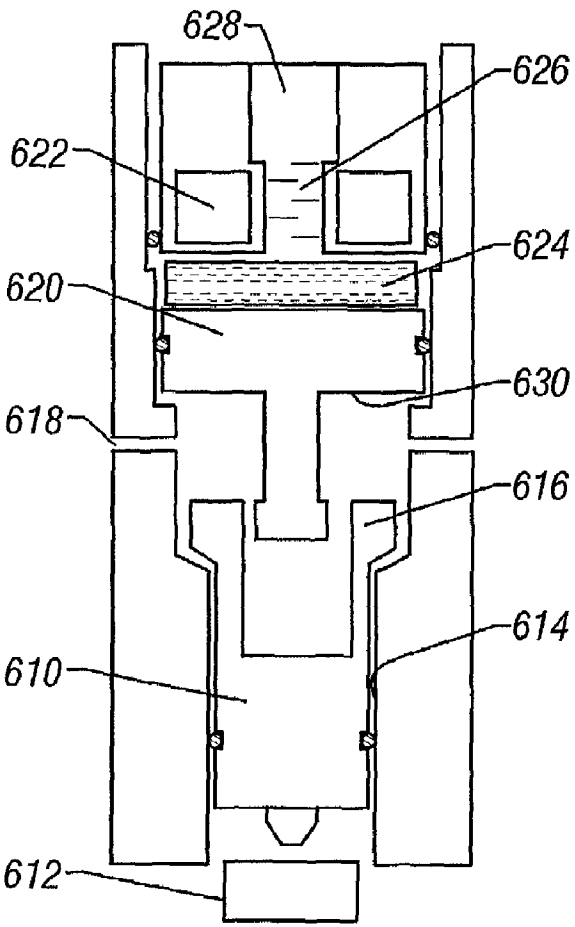

An alternate embodiment of the firing head is seen in FIG. 6A. In this embodiment, firing piston 610 is held away from initiator 612, not by shear pins, but by a collet restraint 616. When installed, the collet restraint 616 is held in an open position by a portion of the fluid piston 620. In this open position, the outside diameter of collet restraint 616 is larger than the diameter of the firing piston 610 and cannot traverse the cylindrical surface 614 that contains the firing piston 610. Pressure communication ports 618 are in fluid communication with the surface 630 of the fluid piston 620, but are unable to move fluid piston 620, because of the solid MR fluid formed between sections of magnetic assembly 622. FIG. 6B shows this same embodiment after the magnetic flux between magnetic assemblies 622 have been cancelled, allowing solid MR fluid 626 to liquefy. This, in turn, allows the fluid piston 620 to be pushed away from the collet restraint 616, so that the collet restraint 616 can collapse inward, allowing the firing piston 610 to strike initiator 612.

In either of the MR embodiments above, it would be possible to add a time-delay feature to the firing of the guns by a simple means. Rather than entirely canceling the magnetic field in magnetic assembly 622, the field can be partially cancelled, so that the MR fluid in the gap is in a semi-solid state with a given flow rate. The chosen flow rate would determine the time necessary for the pressure ports 618 to open and fire the guns. Many other embodiments can also be designed to enable time delay.

Figure 7C:
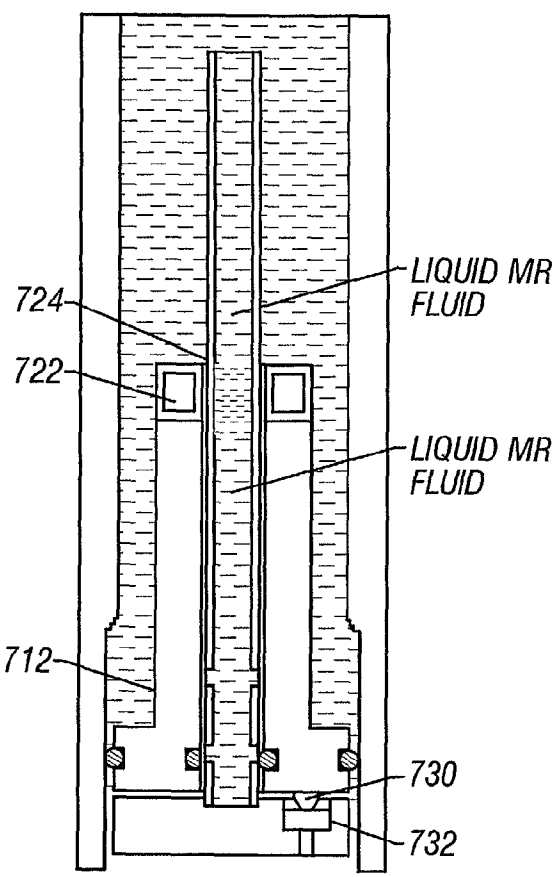
FIGS. 7A–C show another example of a firing pin with a lock and/or time delay feature provided by MR fluid.
Figure 7B:
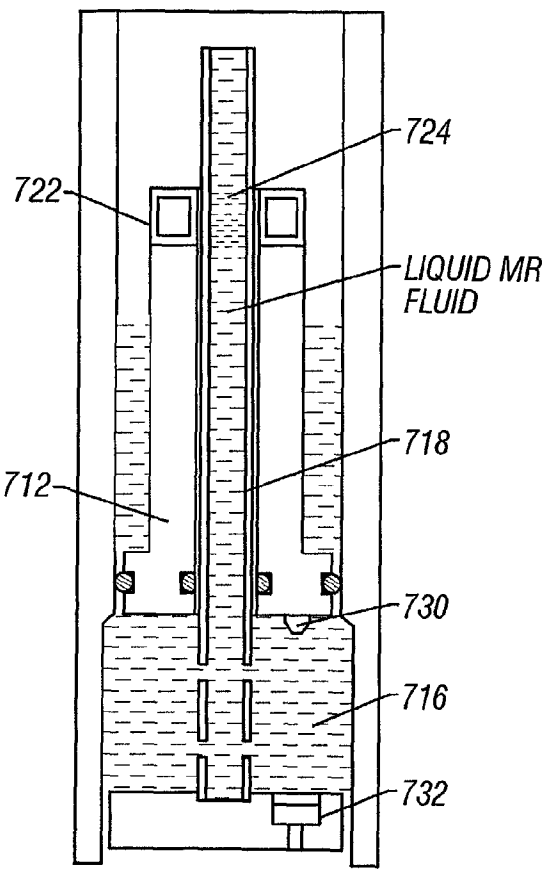
Figure 7A:
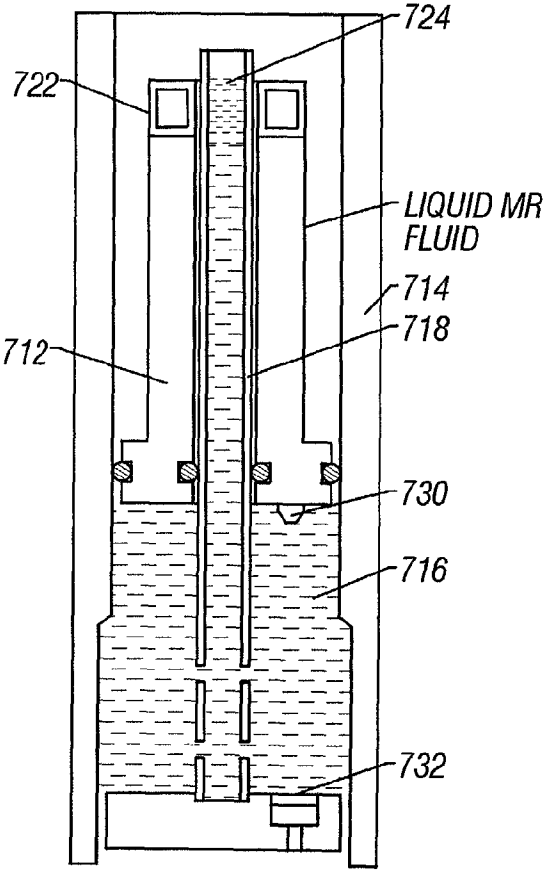

FIGS. 7A–C provide another example of a firing pin with a lock and/or time delay feature provided by MR fluid. In the prior art, delayed firing could be achieved by a pyrotechnic delay element, which is expensive, or a fluid delay, which requires a complex spring mechanism and expensive orifices that are susceptible to clogging and failing. MR fluid control offers an inexpensive, simple alternative. In this example, a cylindrical piston 712 moves through a cylinder 714 containing MR fluid 716. Fluid that is displaced by the piston travels up a tube 718 that goes through the center of the piston, to be collected in the region behind the piston. A magnetic assembly 722 can produce a magnetic field through the tube 718, to either slow or stop the progress of the piston through the fluid. When the magnetic field is strong enough to solidify the MR fluid, it acts as a lock; when the magnetic field is lower, a semi-solid plug of MR fluid 724 will a delay the movement of the piston in a predictable manner. This can be used, for instance, to provide a fuse in which the firing does not occur immediately after the event is triggered, but is delayed for a given period of time. The sequence of drawings, FIGS. 7A–C, shows the piston as is descends. The time necessary for piston 712 to descend until firing pin 730 contacts explosive initiator 732 can be varied by varying the strength of the magnetic field produced by assembly 722.

The use of MR fluid in implementing a TCP gun is only one example in which a safety lock or time-delay feature can be implemented using an MR valve. A valve using MR fluid can be used in any tool that relied on a failure mechanism to allow movement, such as vent devices that rely on shear pins, setting packers that rely on brass lugs, valves that rely on rupture discs, secondary release mechanisms that rely on shear pins or the shear of threads, live well intervention tools that rely on collapsing springs or shear pins, sub-surface safety valves, bridge plugs, etc. Many others will occur to one of ordinary skill in the art.

Position Control

Position control is defined in this context as a device that can repeatably have multiple positions that include restoring the device to its original position. To control the position of a part, the part is connected to a piston, which moves through a cylinder filled with MR fluid. Using a magnetic field to solidify the MR fluid in the cylinder prevents movement of both the piston and the part, while canceling the magnetic field allows movement. The speed of movement can also be controlled by the strength of the magnetic field. Two specific examples are a circulating valve and a travel joint.

Figure 8A:
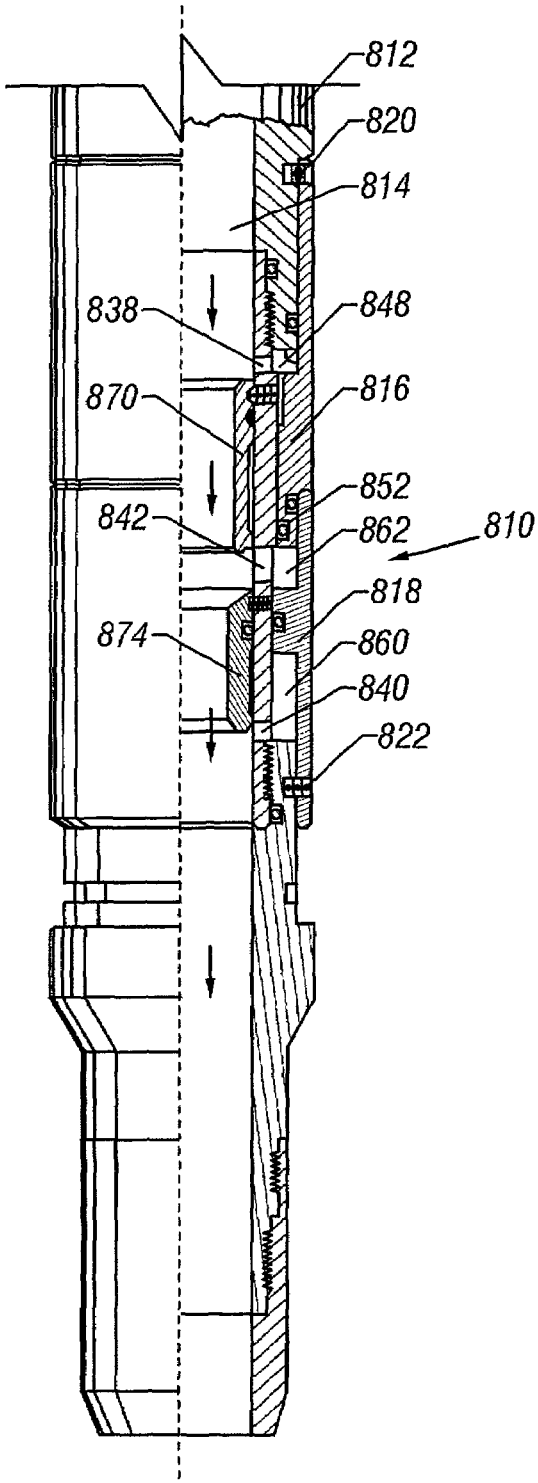
FIG. 8A (Prior Art)
FIGS. 8A–C show a prior art circulating valve.
Figure 8B:
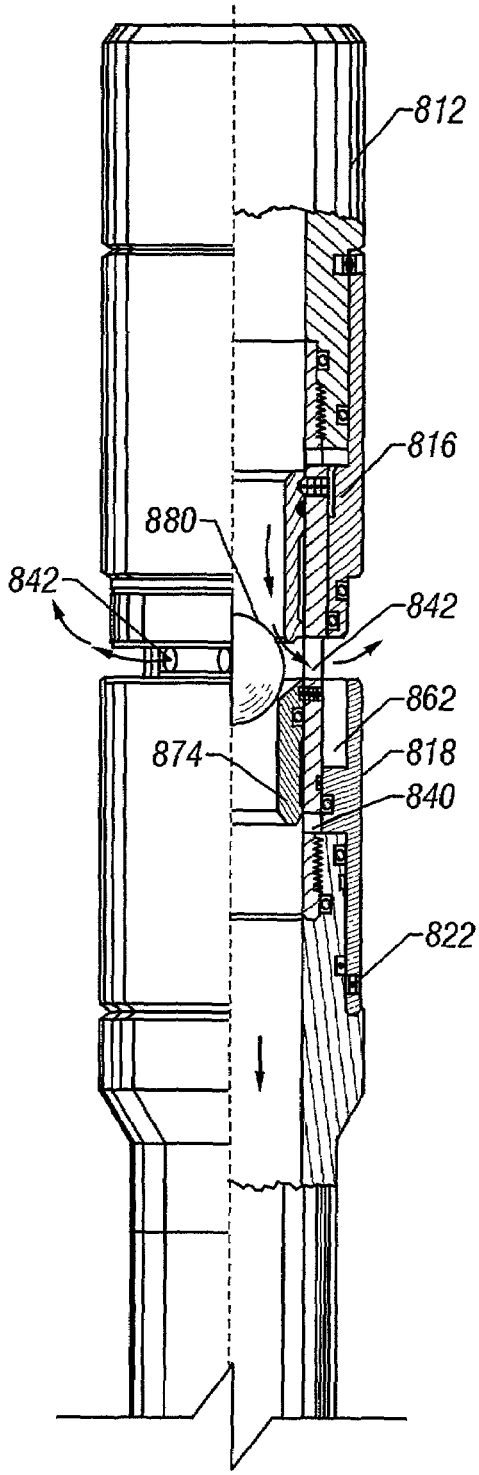
FIG. 8B (Prior Art)
Figure 8C:
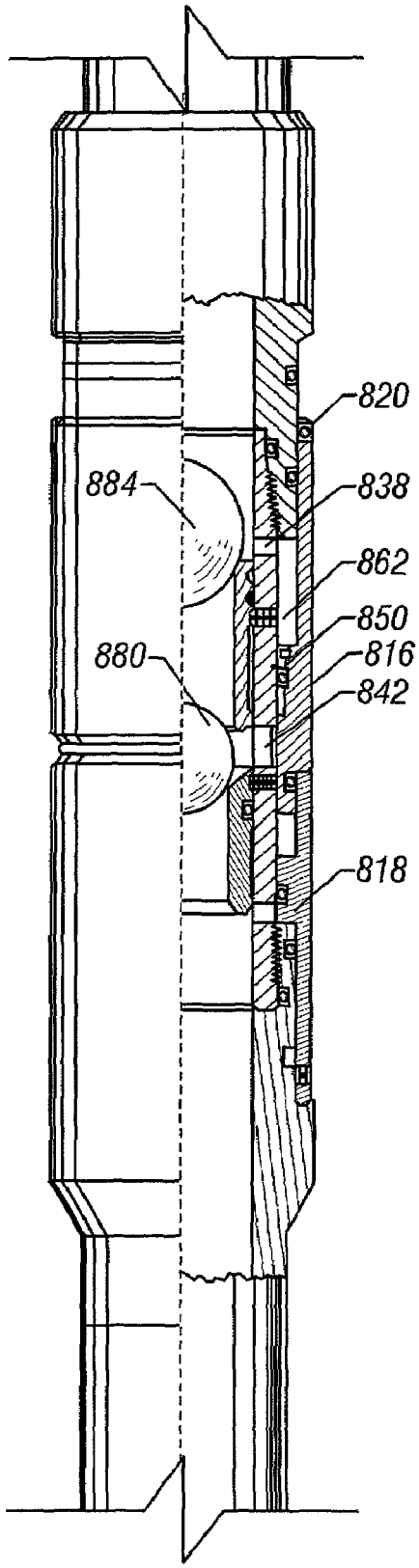
FIG. 8C (Prior Art)

A circulating valve can be used to direct the flow of fluids in well tubing to different destinations, for instance, the valve can originally be closed, so that fluids move down the tubing, later opened to allow fluids in the tubing to exit to the annulus, and finally closed again to halt downward circulation. There are many different means of implementing a circulating valve, including valves that are operated by a wireline tool, by annulus pressure, or by internal tubing pressure. One example of a prior art circulating value is disclosed in U.S. Pat. No. 5,048,611, which is briefly discussed here. FIGS. 8A–C show this earlier circulating valve. Drill pipe 812 is connected to valve 810, and together form a continuous passageway 814 for fluid flow (see also arrows). Passageway 814 has numerous openings 842, which are isolated from the annulus by sliding members 816 and 818. These sliding members 816 and 818 are held in place by shear pins 820 and 822. In addition to openings 842, which open to pressure area 862, openings 838 and 840 open respectively to pressure areas 848 and 860. As will be seen, these pressure areas are used to open and close valve 810.

When circulation to the annulus is desired, a ball 880 is dropped into valve 810, which seats at a lower valve seat member 874, closing off the bore of the tubing and permitting pressure to rise. This rise in pressure is transmitted, through openings 842 (but not through openings 840, which are sealed off) into pressure area 862, where the pressure forces sliding member 818 to move in a downward direction after shearing the shear pins 822, opening the valve, as seen in FIG. 8B. To stop circulation, shown in FIG. 8C, a larger diameter ball 884 is pumped down the pipe to seat on upper valve seat member 870, allowing the pressure above ball 884 to rise. This pressure is transmitted, through opening 838, to pressure area 848, where the pressure forces sliding member 816 to move downward after shearing shear pins 820, once again closing the valves. A one-way ratcheting member 850 prevents a return of the upper sleeve member 816, so that the valve remains closed.

Figure 9A:
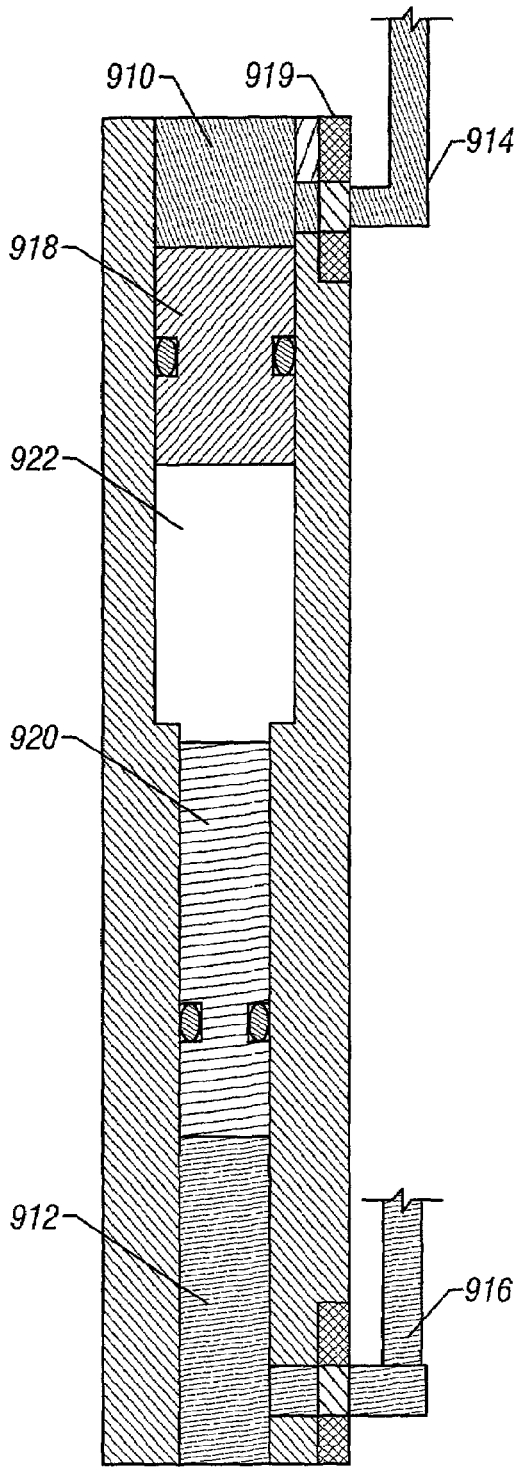
FIG. 9A shows a three-way valve such as can be used in a circulating valve, while FIGS. 9B–C demonstrates the valves in the tubing that can be controlled by the three-way valve.

As a replacement for the prior art circulating valves, it is disclosed to use an MR-fluid controlled valve. To allow for a three-way choice, a three-way valve can be used; one exemplary three-way valve is shown in FIG. 9A. In this figure, the valve is split into three chambers, 910, 922, and 912 by floating pistons 918 and 920. Chamber 910 is filled with MR fluid and is connected to high-pressure hydraulic line 914 through magnetic valve 919, while chamber 912, also filled with MR fluid, is connected to low-pressure hydraulic line 916 through magnetic valve 915. Chamber 922 contains an inert gas and is initially pressurized to a pressure equal to the low-pressure line. Piston 918 is moved in a downward direction by opening magnetic valve 917 and applying pressure. If magnetic valve 915 is opened while piston 918 is in its lower position, piston 920 will also be forced to a lower position due to the increased pressure in the gaseous chamber between the two pistons. If valve 915 is then closed and the pressure released from chamber 910, piston 918 will return to its original position, but piston 920 will remain in the lower position. Subsequent opening of valve 915 will allow piston 920 to return to its original position.

Figure 9B:
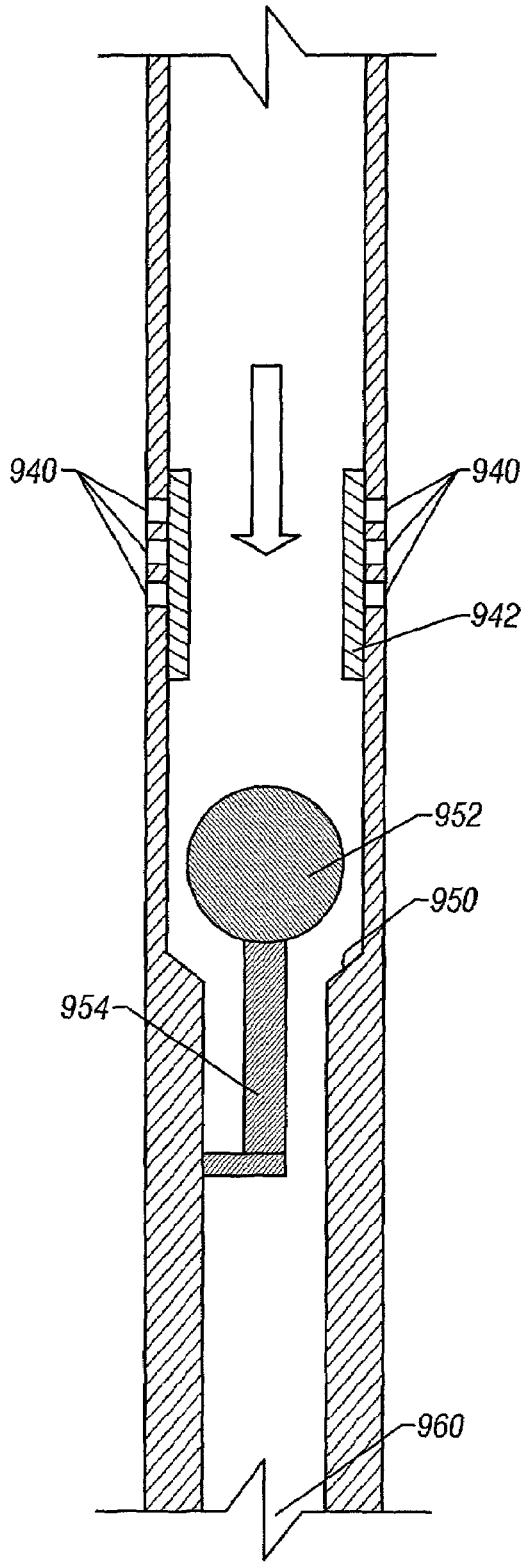
Figure 9C:
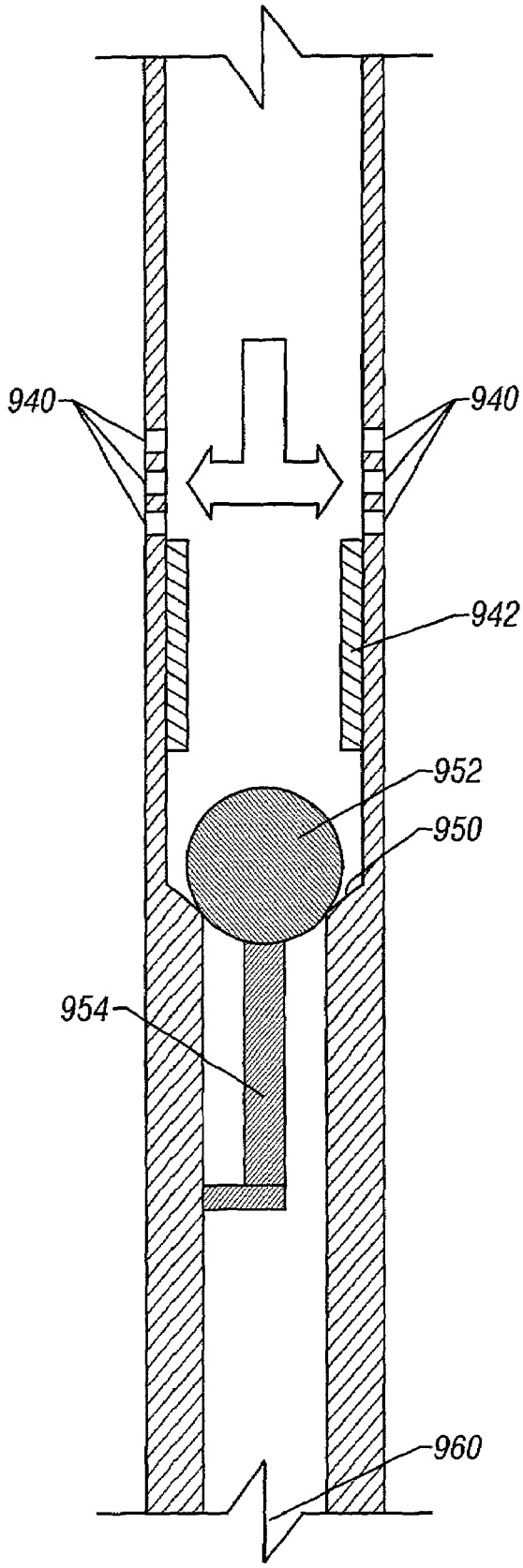

FIG. 9B is a diagram of a section of tubing in which the valve can be embedded (these drawings are not to any scale), showing an initial position. In this tubing, fluids moving down the tube can be pumped out of the tube either at the openings 940 in the sidewalls of the tubing or out the end 960 of the tube. A sliding annular section 942 of tubing is currently blocking fluid flow out openings 940 in the sidewall of the tubing. Below openings 940, the inside diameter of the tubing narrows, providing a seating area 950 for a ball 952, which can be seated to seal the main bore of the tubing. Ball 952 can be raised and lowered by rod 954, to permit or block respectively the flow of fluids down the tubing. FIG. 9C shows a later position of the valve, with openings 940 exposed so that fluid can flow through them. At the same time, ball 952 has been lowered to seat in seating area 950, closing the downward flow of fluids. While these actions have both happened, it is not necessary that they happened at the same time. If the position of piston 918 is tied to the sliding annular section 942 of tubing and the position of piston 920 is tied to rod 954, the three-way valve of FIG. 9A can control the flow of fluids in FIGS. 9B–C. If both MR valves 915 and 919 are open, so that a high pressure is applied to piston 918, slideable section 942 will be moved, opening tubing to the annulus at that point, while ball 952 is lowered and closes the flow downhole. Both pistons 918 and 920 can be frozen in this position by turning on magnetic assemblies 915 and 919 to close their respective valves. If the magnetic field at assembly 919 is later released while the magnetic field at 915 remains, sliding section 942 closes openings 940 while the ball valve remains seated, stopping all flow. A particular advantage of the innovative valve is that, unlike the prior-art circulating valve, the MR fluid valve can be opened and closed repeatedly, simply by controlling the input pressures and the magnetic assemblies. There are no shear pins or similar devices that must be redressed before other uses of the circulating valve.

Figure 10A:
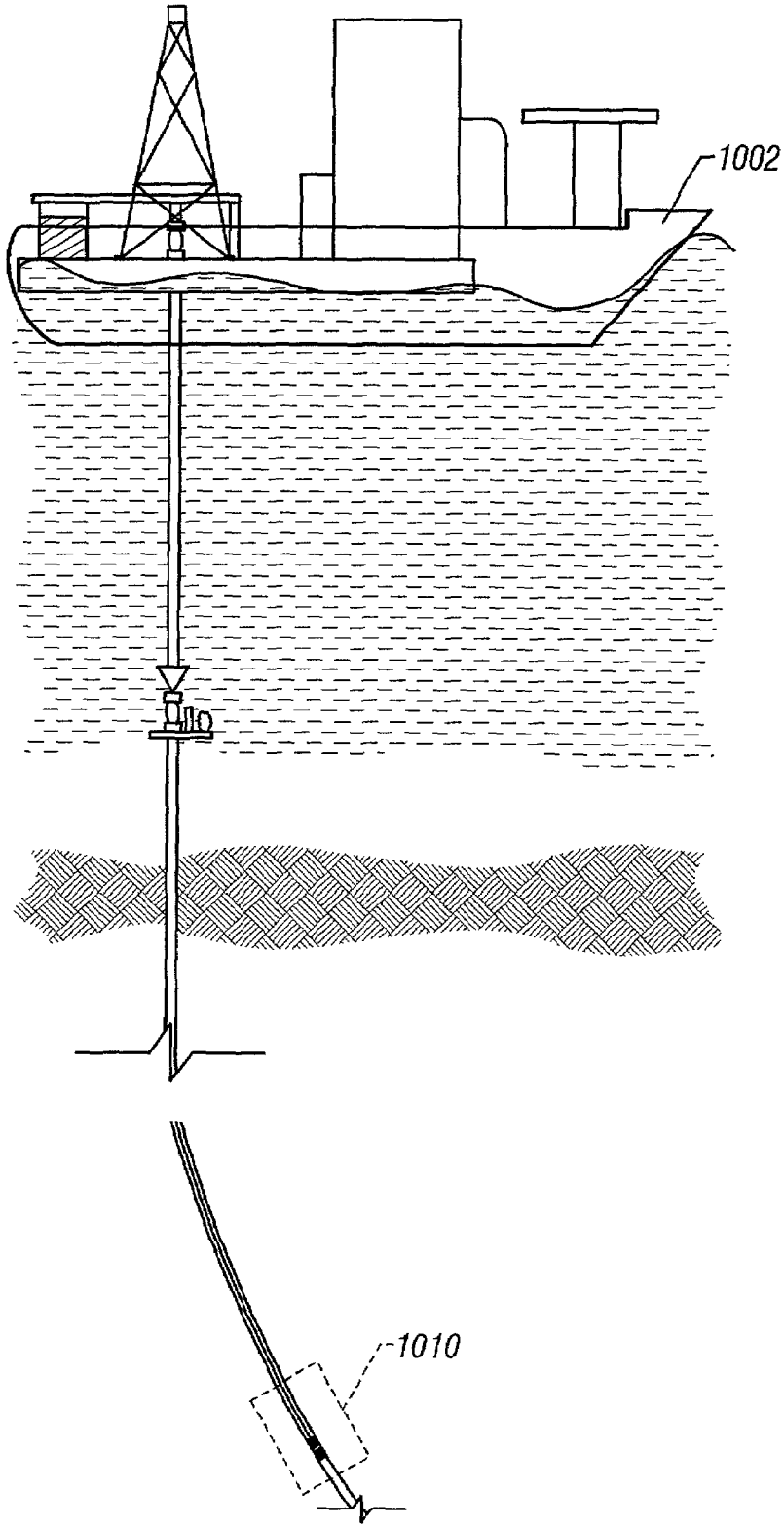
FIG. 10A (Prior Art)
FIGS. 10A–C show a prior art travel joint in a drill string, in both a locked and an unlocked position.
Figure 10B:
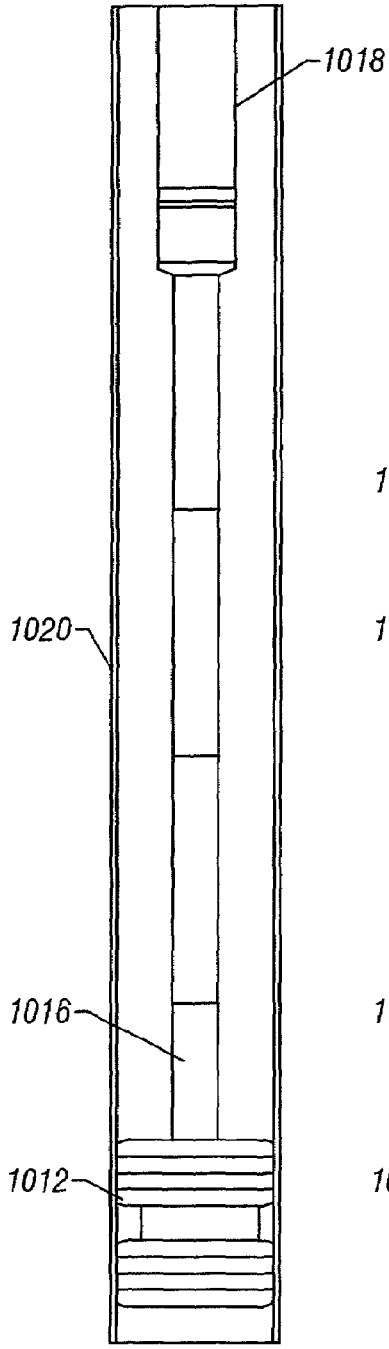
FIG. 10B (Prior Art)
Figure 10C:
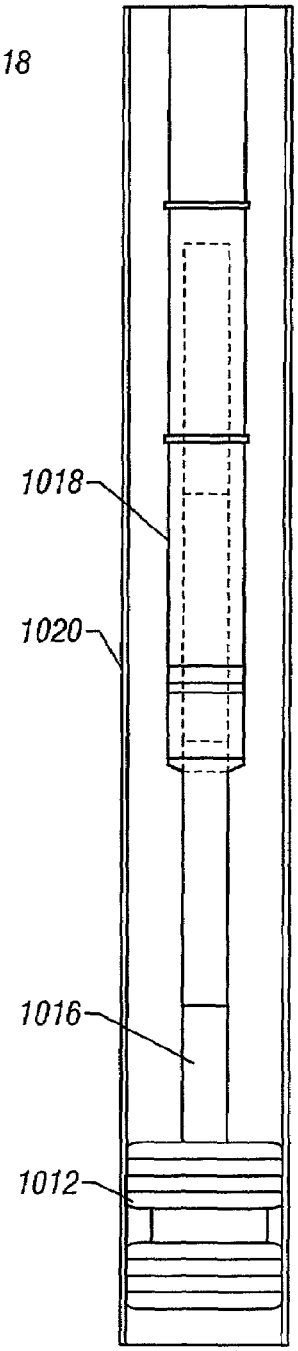
FIG. 10C (Prior Art)

Another use for magnetorheological fluid downhole is in a travel joint, shown as part of the drill string in FIG. 10A, and enlarged in FIGS. 10B and 10C. A travel joint 1010 is used in offshore drilling operations to allow a given amount of vertical movement between a fixed point in a borehole 1020, such as a packer 1012, and the drilling ship 1002. A section of tubing 1018 encloses a smaller diameter section of tubing 1016 in a telescoping manner, with seals between the two sections to keep fluids from entering the structure when in place. The two sections of tubing 1018 and 1016 must be in a locked relationship to each other when making a connection to the fixed structure, shown in FIG. 10B, but tubing 1016 must be able to move in a sliding relationship with 1018 at other times, see FIG. 10C, in response to movement of the drillship.

Prior art travel joints are discussed in co-pending application Ser. No. 09/452,047, filed Nov. 30, 1999 and titled "Hydraulically Metered Travel Joint", which is hereby incorporated by reference. Many of these prior art applications have used shear pins to maintain the locked relationship of the two sections of tubing prior to their installation. If the shear pins are prematurely broken, the tubing will not properly mate with the packer; and the entire assembly must be pulled up so that the shear pins can be replaced. In other cases, the release of the shear pins may require an excess of pressure, increasing the possibility that adjacent structures can be damaged when they release, especially in a deviated borehole.

Figure 11:
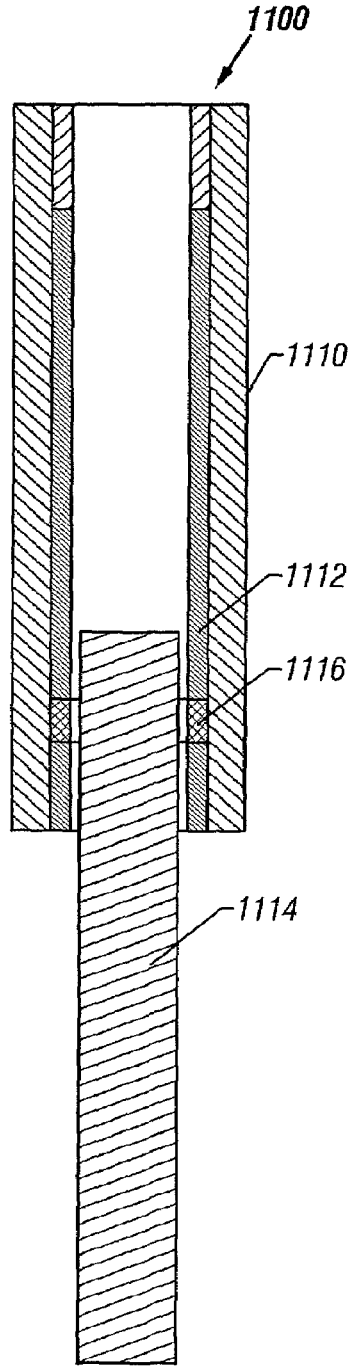
FIG. 11 shows a partial cutaway of a travel joint designed to utilize MR fluid for position control.

In an embodiment of the present invention, shown in FIG. 11, the wall of outer section 1110 of travel joint 1100 contains a chamber 1112 filled with MR fluid. Inner section 1114 of the travel joint is tied to piston 1116, which contains a magnetic valve. Piston 1116 moves freely through chamber 1112 whenever its magnetic valve is open, but is locked in position when the valve is closed. Thus, the position of inner section 1114 relative to outer section 1110 can be fixed at any point along its travel path, simply by closing the valve in piston 1116. Additionally, partially closing the MR valve, so that the MR fluid forms a semi-solid, can provide a dampening effect on the movement of the joint.

In this application, use of MR fluids allows the two joints to be locked to each other in a variety of positions. Shear pins are unnecessary, so the possibility of premature breakage or the use of excessive force to shear the pins is avoided.

Hydraulic Logic Control Circuits

As seen in the general example above, if MR fluid is used as a hydraulic fluid, a magnet can serve to open or close the valve. An array of magnets and/or electromagnets can also be used to control the MR fluid to create digital hydraulic control circuits. The magnets would allow different hydraulic control systems to communicate with common high-pressure lines and low-pressure lines, while at the same time allowing them to be isolated from the pressure lines at other times.

Figure 12:
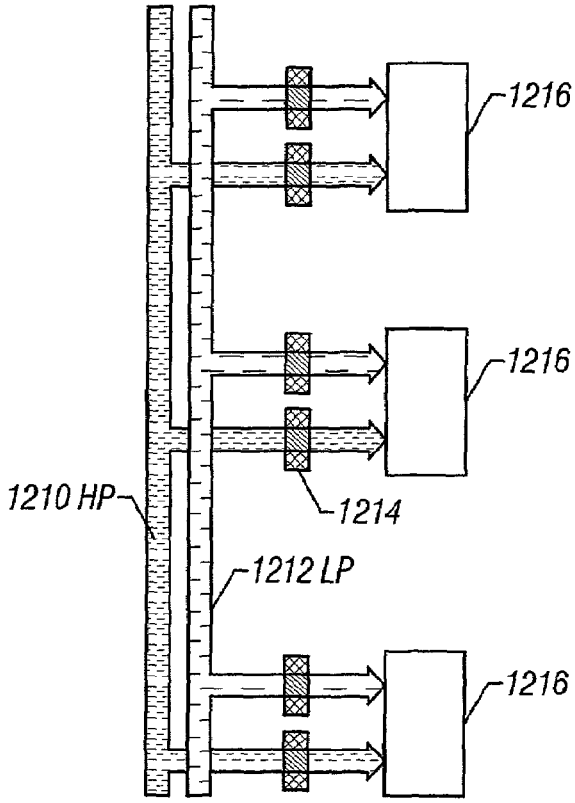
FIG. 12 shows a schematic of a number of downhole pieces of equipment, each tied to high-pressure and low-pressure control lines and controlled through the use of magnetorheological valves.

FIG. 12 shows a schematic of a number of downhole pieces of equipment 1216, each of which are tied into both a high-pressure control line 1210HP and a low-pressure control line 1212LP. Between each piece of equipment and its associated connections to the high-pressure line 1210HP and low-pressure line 1212LP is an MR valve 1214. Each pair of valves will control a single piece of equipment; depending on the type of equipment and its requirements, each valve can separately be determined to have a fail-on or a fail-off condition.

Figure 13:
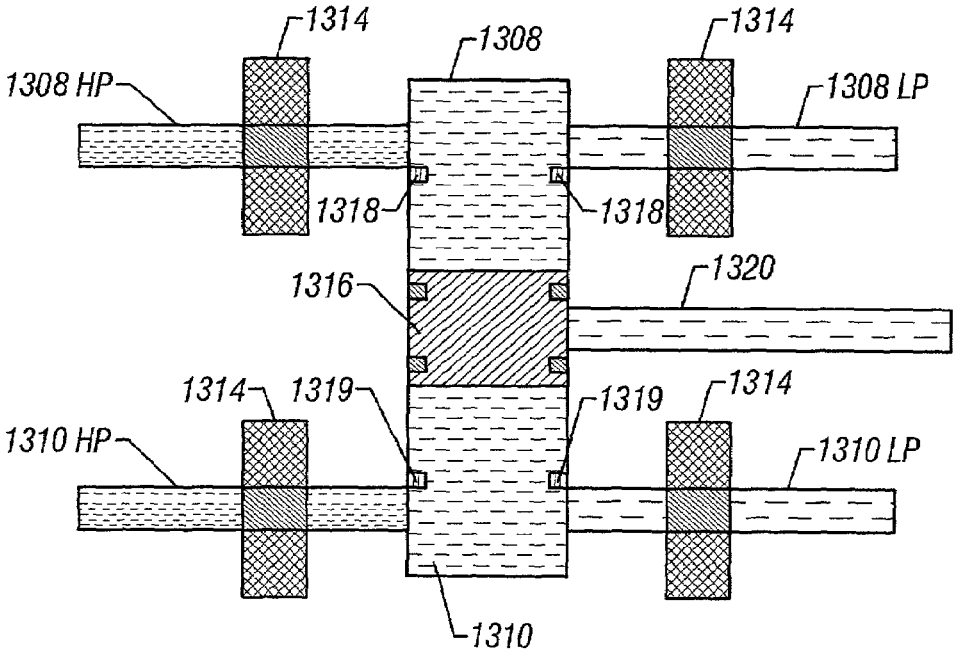
FIG. 13 shows a magnetorheological valve that would reflect the logical function of an exclusive "OR" applied to the two inputs.

Of course, with a system of control valves such as is shown, there is no reason why more complicated logic cannot be applied to control the equipment. For example, shown in FIG. 13 is a valve that would reflect an exclusive "OR" condition, in which the corresponding values of input and output are:

| Input 1 | Input 2 | Output |
|---|---|---|
| 0 | 0 | 0 |
| 0 | 1 | 1 |
| 1 | 0 | 1 |
| 1 | 1 | 0 |

In this exemplary valve, a chamber is divided into separate chambers 1308 and 1310 by floating piston 1316, which is moveable between stops 1318 and 1319. Both of chambers 1308 and 1310 contain MR fluid and are connected to respective high-pressure lines 1308HP and 1310HP and to respective low-pressure lines 1308LP and 1310LP through respective MR valves 1314. A logical "1" is shown in either chamber by opening the valve on the high pressure side and closing the valve on the low pressure side. Conversely, a logical "0" is shown in either chamber by closing the valve on the high-pressure side and opening the valve on the low-pressure side. An output value is taken at line 1320. It can be seen that if either of chambers 1308 or 1310 have a "1" value while the other has a "0" value, piston 1316 will be moved to one side, opening output 1320 to reflect the high pressure from whichever chamber has a value of 1. If both chambers 1308 and 1310 are "1" or both chambers are "0", the piston will remain centered, blocking a high-pressure output on line 1320.

One of ordinary skill can design other logical arrangements to reflect other logical values, such as inclusive "OR", "AND", and "NOT". Using these logical relations, downhole equipment can be "programmed" to respond in a given manner to known input. In turn, this can mean faster response time to changing conditions, as the equipment can receive input from downhole sensors and perform a programmed response, rather than waiting for control signals from the surface.

Packers and Plugs

Conventional packers generally use rubber as the sealing element. A toroidal rubber element surrounds the drill string as it is being fed into the borehole. Once the packer assembly is at the desired position, the rubber packer element is compressed to force it to bulge against the casing wall, providing a seal. The typical rubber packer element requires a high force in order to be able to set it. Alternatives to rubber packer elements, such as inflatable packers, typically will not hold against a large differential pressure in the borehole, and are less useful. It would be desirable to find a packer element that did not need a high force to set it, yet could withstand a large differential pressure. It would additionally be desirable if such a packer element could provide a seal even when the borehole is damaged or deformed.

In the innovative embodiment disclosed herein, the rubber packer elements are replaced with a compliant toroidal balloon filled with magnetorheological fluid. The purpose of the balloon is to contain the MR fluid while the magnetic field is not activated, as the balloon does not contribute to the holding force of the packer element. Once in the hole, a magnetic field is activated and the MR fluid instantly solidifies and forms a strong seal in the annulus. The result is a packer that requires a low setting force yet can hold a high differential pressure.

Figure 14A:
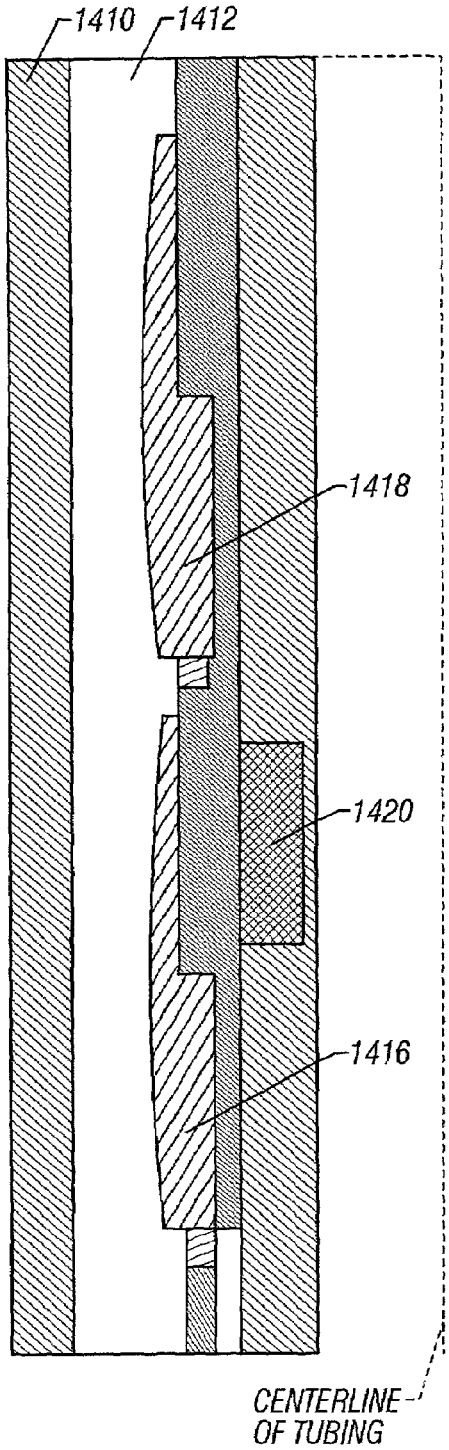
FIGS. 14A–C show a packer, utilizing MR fluid, which can be set with little effort, but which can withstand a large pressure differential across the packer.
Figure 14B:
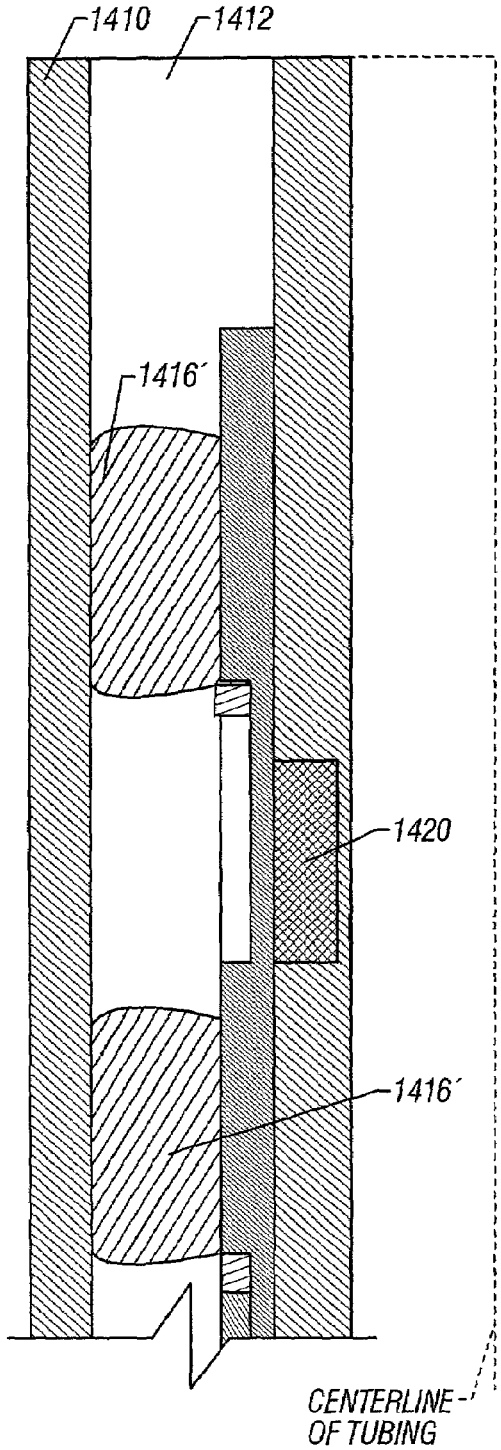
Figure 14C:
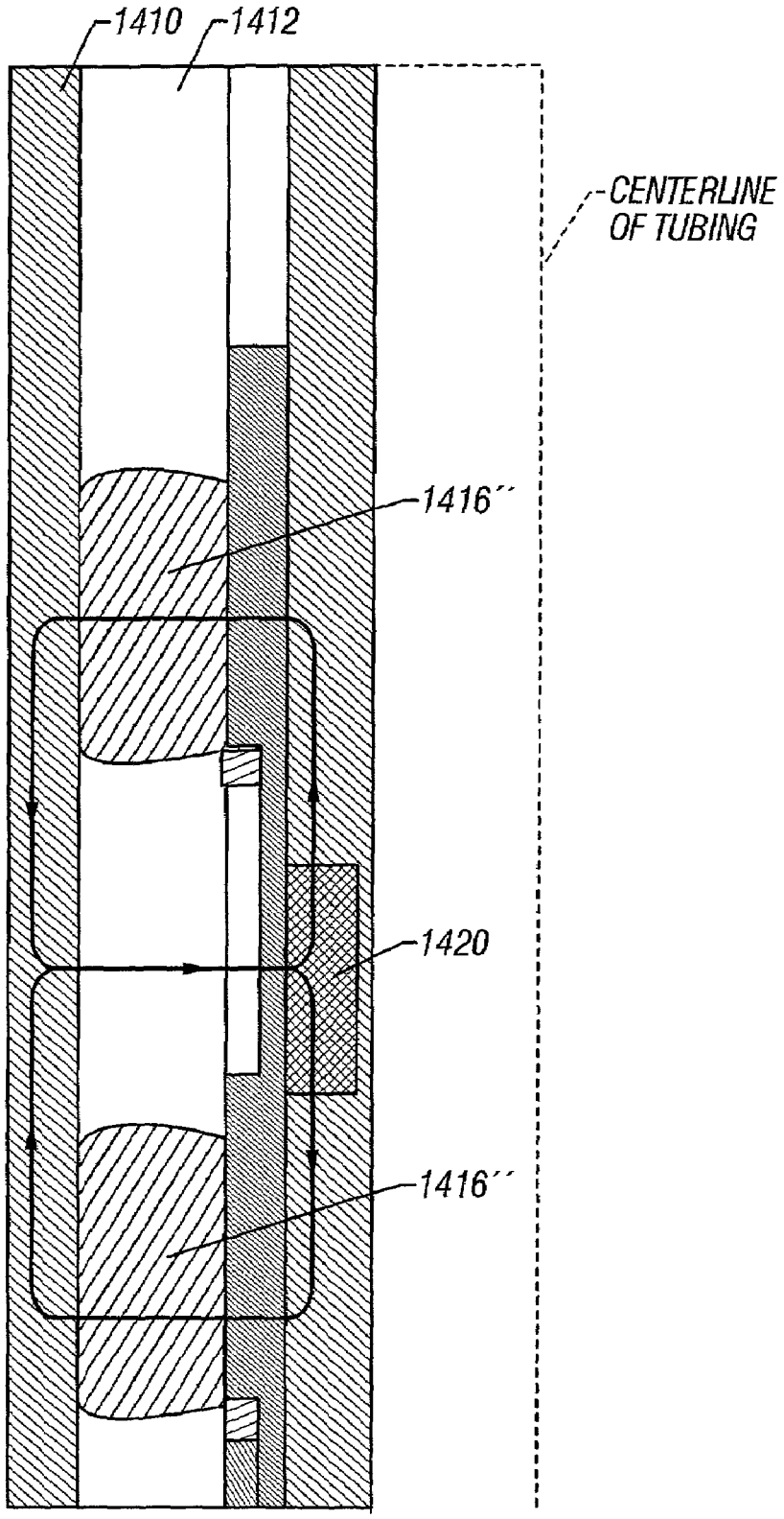

An exemplary embodiment of a packer using MR fluid is shown in FIGS. 14A–C. In the drawings shown, only a portion of the borehole is shown, with one side of the casing 1410, annulus 1412, and packer 1416 seen. The packer, which is a part of a string of tools, is run in a borehole in a collapsed position, as seen in FIG. 14A. In this embodiment, packer 1416 is a rubberized tube filled with MR fluid. The specific material used to form the sack is not critical to the invention, but must have enough integrity to withstand being run into the borehole. It can be possible to have a temporary container that holds the MR fluid prior to the magnetic field being applied. The fluid can be released into the desired region after the magnetic field has been applied, so that the fluid is solidified as it enters the magnetic field and remains in place.

The magnetic assembly 1420 is located in the wall of the tool string containing the packer. Preferably, the packer element 1416 is split into two sections in order to better utilize the magnetic field. During run in of the assembly, the magnetic field would not be active. Once the tools are in position, the packers are mechanically compressed so that they bulge into the wall of the casing, as shown in FIG. 14B. However, unlike packers using rubber elements, large amounts of force are not needed to set the MR packers. The last step is simply to apply a magnetic field to the set packers, as is shown in FIG. 14C. For packers that will only be in place for a relatively short time, electromagnets can be used to power the magnetic assembly, using either a wire-line current or battery power to create the magnetic field. For packers that will remain in place for a longer time, permanent magnets can be used for the magnetic assembly, with electromagnets used to inactivate the magnetic field during the trip downhole. The required magnetic field can be generated by permanent magnets approximately ½ inch thick.

The pressure differential that the MR fluid can support is a function of the gap between the packer and the casing that the fluid fills and the length of the MR packer. The differential pressure that the MR fluid can hold, according to *Engineering Note, Lord Materials Division*, is $$\Delta P = \frac{3\tau_y L}{g}$$

where $\tau_y$ is the shear strength of the activated MR fluid, which is 8.7 psi, L is the length of the packer element, and g is the gap between each side of the packer and the casing. If we assume that g is 0.25 inch and the length of the packer is 48 inches, the packer could support a 5,000 psi pressure differential. Note that the MR fluid-based packer can support a pressure differential in either direction.

Some of the advantages of using MR fluid in packer elements include:

requires a low setting force holds a high differential pressure (5,000 pounds/square inch for a 4 foot length)

is retrievable can seal in highly damaged or deformed casing

Although this example has been given in terms of a packer, the same idea could be adapted for use as a plug, to block the flow of fluids within a tube. A plug can be formed of a balloon-like structure containing MR fluid, capable of being deformed in order to seal the tube. During transit in the tube, no magnetic field is produced and the plug remains fluid. At the desired location, however, the balloon structure is deformed to contact the walls of the tubing and the magnetic field is turned on, solidifying the fluid into a plug blocking the tube.

A number of exemplary devices for use in the drilling and production of oil and gas have been demonstrated. However, their use should not be construed as limited to the examples given. Many variations of and modifications to these examples are possible. Additionally, MR valves can be combined with other innovative designs to enhance downhole operations. For example, if the valves are made of magnets, with electromagnets to allow changes in position, batteries can be used to power the valves, relieving the need for electrical connections. Instructions to the valves can be sent by means such as acoustic telemetry, which is discussed in copending application Ser. No. 10/059,782, filed Jan. 30, 2002. This can give maximum control to the operator, without sacrificing flexibility.

We claim:

1. A method of selectively blocking or delaying a downhole event, the method comprising the steps of;

connecting a housing containing a piston in such a manner that completion of said downhole event is dependent on said piston arriving at a given location within said housing;

disposing a magnetorheological fluid within said housing in such a manner that said piston is impeded from moving toward said given location; and creating a magnetic field through at least a portion of said magnetorheological fluid, the magnetic field being of sufficient magnitude to slow, but not stop, movement of said piston through said magnetorheological fluid.

2. A system for controlling operation of at least one well tool, the system comprising:

a string including the well tool deployed in a borehole;

a housing of the well tool, the housing containing a piston;

a magnetorheological fluid disposed within said housing; and a magnetic assembly including a working gap having a first magnetic field strength, and a reluctance gap having a second magnetic field strength capable of switchably changing said first magnetic field strength, said second magnetic field strength passing through said housing, wherein blockage of a flow of magnetorheological fluid through said housing by said first magnetic field strength impedes movement of said piston.

3. The system of claim 2, wherein total blockage of said flow stops movement of said piston.

4. The system of claim 2, wherein partial blockage of said flow slows movement of said piston.

5. The system of claim 2, wherein said magnetic assembly comprises a permanent magnet and an electromagnet, and wherein said first magnetic field strength and said second magnetic field strength result from a lack of current in said electromagnet.

6. The system of claim 2, wherein said magnetic assembly comprises an electromagnet, and wherein said first magnetic field strength and said second magnetic field strength result from a current in said electromagnet.

7. The system of claim 2, wherein said piston is held immobile by a lack of current in said magnetic assembly, thereby providing a safety lock.

8. A fluid control device used in a borehole, the device comprising:

a housing containing a piston;

a magnetorheological fluid disposed within said housing; and a magnetic assembly capable of switchably creating a magnetic field which passes through said housing, wherein said magnetic field is switchably created by a selected one of a short circuit and an open circuit, and wherein blockage of a flow of magnetorheological fluid through said housing by said magnetic field impedes movement of said piston.

9. The device of claim 8, wherein said open circuit is created by a hydraulic pressure.

10. The device of claim 8, wherein said open circuit is created by a mechanical force.

11. The device of claim 8, wherein said short circuit is created by a hydraulic pressure.

12. The device of claim 8, wherein said short circuit is created by a mechanical force.

13. The device of claim 8, wherein total blockage of said flow stops movement of said piston.

14. The device of claim 8, wherein partial blockage of said flow slows movement of said piston.

15. The device of claim 8, wherein said magnetic assembly comprises a permanent magnet, and wherein a lack of current in said magnetic assembly generates said magnetic field.

16. The device of claim 8, wherein said piston is held immobile by a lack of current in said magnetic assembly, thereby providing a safety lock.

17. The device of claim 8, wherein movement of said piston is controlled to provide a time-delay device.

18. A firing head f or use in a well, the firing head comprising:

a magnetic assembly;

a magnetorheological fluid; and a firing piston, the firing piston being prevented from displacing when the magnetic assembly applies a magnetic field having a strength level to the magnetorheological fluid, wherein the magnetic field has an altered strength level at which the magnetic field does not impede flow of the magnetorheological fluid, thereby permitting displacement of the firing piston, and wherein the altered strength level is produced by at least one of displacement of a portion of a magnetic circuit of the magnetic assembly and transfer of the magnetic field relative to a reluctance gap.

19. The firing head of claim 18, wherein a decrease in the magnetic field strength level applied to the magnetorheological fluid releases the firing piston from a restraint, thereby permitting the firing piston to displace.

20. The firing head of claim 18, wherein a decrease in the magnetic field strength level permits the firing piston to displace, thereby firing the firing head.

21. The firing head of claim 18, wherein the firing head is connected to a perforating gun.

22. A firing head for use in a well, the firing head comprising:

a magnetic assembly;

a magnetorheological fluid; and a firing piston, the firing piston being prevented from displacing when the magnetic assembly applies a magnetic field having a strength level to the magnetorheological fluid, wherein the magnetic field has an altered strength level at which the magnetic field impedes, but does not completely stop, flow of the magnetorheological fluid, thereby slowing displacement of the firing piston.

23. The firing head of claim 22, wherein the altered strength level is produced by current in an electromagnet of the magnetic assembly.

24. The firing head of claim 22, wherein the altered strength level is produced by a lack of current in an electromagnet of the magnetic assembly.

25. The firing head of claim 22, wherein the altered strength level is produced by displacement of a portion of a magnetic circuit of the magnetic assembly.

26. The firing head of claim 22, wherein the altered strength level is produced by transfer of the magnetic field relative to a reluctance gap.

27. A firing head for use in a well, the firing head comprising:

a magnetic assembly;

a magnetorheological fluid; and a firing piston, the firing piston being prevented from displacing when the magnetic assembly applies a magnetic field having a strength level to the magnetorheological fluid, wherein a decrease in the magnetic field strength level applied to the magnetorheological fluid permits a valve to open, thereby applying increased pressure to the firing piston.

* * * * *